US007346964B2

(12) United States Patent
Siegel

(10) Patent No.: US 7,346,964 B2
(45) Date of Patent: Mar. 25, 2008

(54) PRESS-ON CLOSURE, PRESS-ON CLOSURE TAPE AND RECLOSABLE BAG

(75) Inventor: Karl Heinz Siegel, Nürnberg (DE)

(73) Assignee: ASF Verwaitungs GmbH, Altdorf (DE)

( * ) Notice: Subject to any disclaimer, the term of this patent is extended or adjusted under 35 U.S.C. 154(b) by 120 days.

(21) Appl. No.: 11/297,812

(22) Filed: Dec. 7, 2005

(65) Prior Publication Data

US 2006/0143878 A1 Jul. 6, 2006

(30) Foreign Application Priority Data

Dec. 7, 2004 (DE) ..... 20 2004 018 940 U

(51) Int. Cl.

| | |
|---|---|
| ***B65D 33/24*** | (2006.01) |
| ***B65D 33/25*** | (2006.01) |
| ***A44B 19/16*** | (2006.01) |
| *A44B 19/00* | (2006.01) |

(52) U.S. Cl. ..... 24/399; 24/585.12; 383/63

(58) Field of Classification Search ..... 24/585.1, 24/585.12, 399, 400; 383/63, 64
See application file for complete search history.

(56) References Cited

U.S. PATENT DOCUMENTS

RE28,969 E * 9/1976 Naito ..... 383/65
6,594,872 B2 * 7/2003 Cisek ..... 24/585.12

FOREIGN PATENT DOCUMENTS

EP 1431203 A1 * 6/2004

* cited by examiner

*Primary Examiner*—Robert J. Sandy
(74) *Attorney, Agent, or Firm*—Alleman Hall McCoy Russell & Tuttle LLP

(57) ABSTRACT

A press-on closure, in particular a press-on closure tape, preferably made of plastics, comprises at least one groove member having a groove and at least one engagement member having an engagement element. The groove member has funnel-shaped webs with inwardly pointing projections. To create a press-on closure or a press-on closure tape, which can be closed even more easily and reliably, a supporting post is each provided on each side of the engagement element.

19 Claims, 2 Drawing Sheets

PRESS-ON CLOSURE, PRESS-ON CLOSURE TAPE AND RECLOSABLE BAG

CROSS REFERENCE TO RELATED APPLICATION

This application claims priority to German Utility Model Application Serial No. 20 2004 018 940.2 filed Dec. 7, 2004 which is hereby incorporated by reference in its entirety for all purposes.

FIELD

This present application relates to a press-on closure, in particular a press-on closure tape, preferably made of plastics. Furthermore, it relates to a reclosable bag, in particular a reclosable packaging bag or a reclosable packaging or another reclosable container, preferably made of plastics, comprising a press-on closure or a press-on closure tape.

BACKGROUND AND SUMMARY

For the reclosability of bags and packagings a multitude of press-on closures and press-on closure tapes are known already. In most cases, these are press-on closure tapes produced by continuous extrusion, which consist of two strands. The two strands mostly are equipped with two or more hooks mutually engaging in each other.

In another type of press-on closure tapes, which are known from US 2003/0077008 A1, one strand has a groove provided with hooks, while the other strand engages in the groove with an arrowhead-like hook.

The integral forming of the press-on closures or press-on closure tapes with bags or packages also is known already.

Mounted in the bag openings, these closures are opened at the so-called gripping tabs by pulling them open and are closed by pressing them shut and stroking along them with thumb and index finger.

However, the prior art closures have the disadvantage that groove and hook tip or hook and double hook must come to lie precisely on top of each other for interlocking and must then be pressed into each other with some resistance, which mostly is very difficult to do for the user and often fails. Then, the bags or packages remain open, and the contents go bad or get dusty or are exposed to other negative environmental influences.

In particular in the case of food packages, where these closures are used to an increasing extent, this disadvantage is particularly disturbing, as after withdrawing parts of the contents, the remainder should be sealed and protected. Closing these closures is also made particularly difficult in that the grooves and hooks are very small, and they often cannot be brought in engagement precisely. Thus, correct closing requires some skill and good eyes.

In single households, mostly only small portions are consumed and therefore partial withdrawals are desired. In these cases, a possibility for reclosing is desired to a particular extent. On the other hand, these single households very frequently are inhabited by elderly people, who not only have lost a certain skill, but also have a deteriorated vision and then frequently do not get along with complicated closing operations.

To meet the currently frequently used requirement of the advertisement and packaging industry to provide some convenience for the consumers, a multitude of sealing bags with a slider, in particular made of plastics, at the top end of the bag or the package are being offered in the field of the reclosable bags and packages. For the consumer, these packages are easy to open and to close by simply moving the slider to and fro, but they have the disadvantage that they are very expensive and technically very complex to manufacture. Another disadvantage consists in that the sliders considerably increase the volume of the stacked bags, so that more packaging is required for these bags.

From EP 1 431 203 A1, a press-on closure tape having a groove member is known. The groove member includes funnel-shaped webs with inwardly pointing projections. The funnel-shaped expansion of the groove member should ensure that upon closing the press-on closure tape the engagement element can safely get into the groove, and in particular also when the engagement element and the groove initially are not yet correctly positioned with respect to each other. However, if the engagement element is pressed in with too much inclination, a part of the press-on closure tape lying beside the engagement element first can impinge on the tip of one of the funnel-shaped webs and prevent the engagement element from smoothly sliding into the groove. Only an increased pressure will then effect interlocking with the groove.

It is an object of the present application to avoid this disadvantage and create a press-on closure or a press-on closure tape, which can be closed even more easily and reliably.

This object may be achieved by a press-on closure, optionally made of plastics, comprising at least one groove member having a groove, which has funnel-shaped webs with inwardly pointing projections (14, 15), and at least one engagement member (7) having an engagement element (8), wherein on each side of the engagement element a supporting post is provided The supporting posts can achieve the effect that the engagement element always impinges substantially straight on the funnel-shaped webs of the groove member. The supporting posts prevent or reduce the likelihood of an inclined position of the engagement element by supporting the same on both sides. The handling of the press-on closure tape thereby is made even more reliable.

Various additional advantageous embodiments may also be achieved.

For example, in one example, the supporting posts extend parallel to the engagement element.

Furthermore, the supporting posts preferably are slightly shorter than the engagement element. If the supporting posts were just as long or longer than the engagement element, the press-on closure tape no longer could be closed reliably or could not be closed at all. On the other hand, when the supporting posts are too short, they can perform their function only insufficiently or not at all. Preferably, the supporting posts are about 2% to 20% shorter than the engagement element, more preferably about 3% to 10%, even more preferably about 5% to 6% shorter than the engagement element.

The reclosable bag or the reclosable packaging examples described herein, which may be made of plastics, such as polyethylene or polypropylene, are characterized by an inventive press-on closure or an inventive press-on closure tape. The reclosable bag or the reclosable packaging and the press-on closure or the press-on closure tape can be formed integrally.

BRIEF DESCRIPTION OF THE FIGURES

One embodiment of the present application will subsequently be explained in detail with reference to the accompanying drawings, in which.

DETAILED DESCRIPTION

Figure 1:
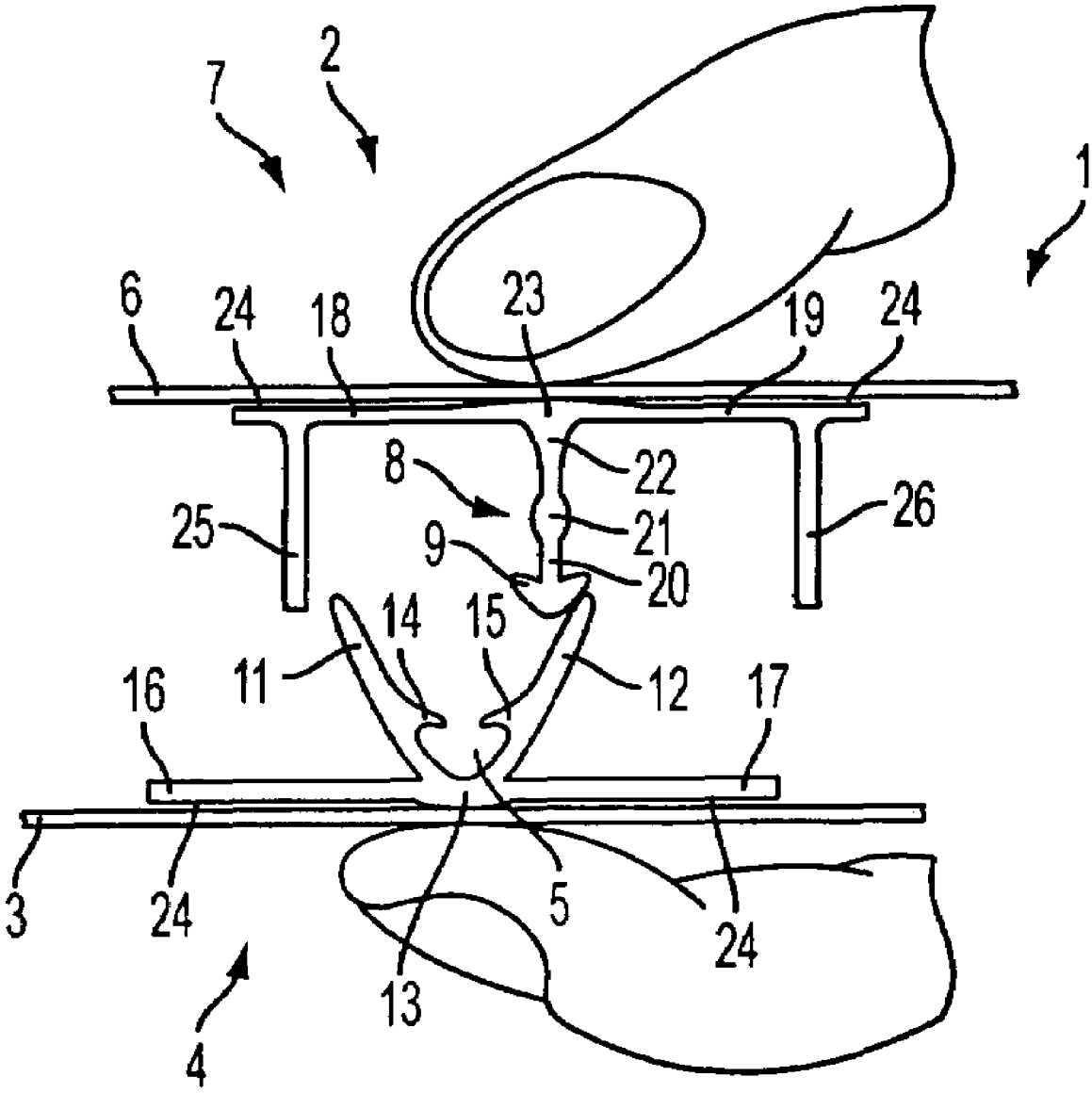
FIG. 1 shows a side view of a press-on closure tape at the beginning of the closing operation.
Figure 2:
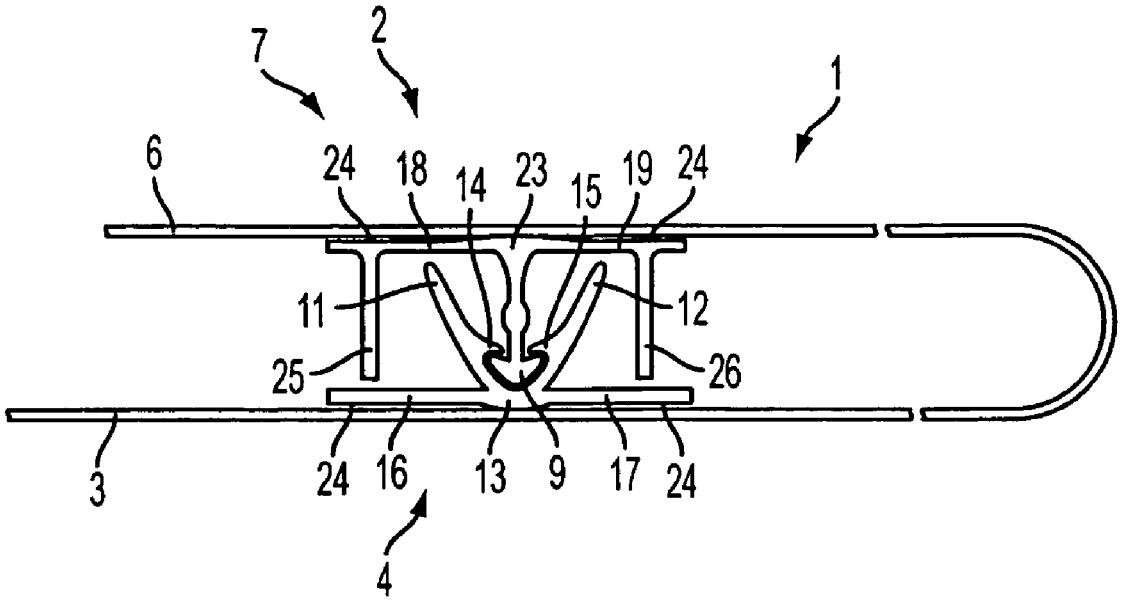
FIG. 2 shows the press-on closure tape of FIG. 1 in the closed position.

FIGS. 1 and 2 show a reclosable bag 1 made of plastics with a press-on closure tape 2 made of plastics. With the first bag wall (rear wall) 3 a groove member 4 is connected, which has a groove 5. With the second bag wall (front wall) 6 an engagement member 7 is connected, which has an engagement element 8. The engagement element 8 ends with an arrow-shaped tip 9, which has a rounded end and side faces each extending at an angle of about 45°.

The groove member 4 has funnel-shaped webs 11, 12. The funnel-shaped webs 11, 12 point upwards at an angle from the base 13 of the groove 5. Their starting points from the base 13 are located at a distance from each other. The angle between the webs 11, 12 is about 60°. Preferably, it lies in the range between 30° and 90°. The webs 11, 12 form a funnel-shaped expansion towards the engagement element 8.

The groove member 4 furthermore comprises inwardly pointing projections 14, 15. The projections 14, 15 each point from the webs 11, 12 to the inside. Their starting point lies slightly below the middle of the webs 11, 12. With the webs, they include an angle of about 45°, which can also be greater or smaller and preferably lies in the range between 30° and 60°. As can be taken from the Figures, the projections 14, 15 slightly extend towards the base 13 of the groove 5. They form a barb for the tip 9 of the engagement element 8.

The groove member 4 and the engagement member 7 are connected with lugs 16, 17, 18, 19, i.e. are integrally connected. The lugs 16, 17 are connected with the thickened base 13 of the groove member 4, namely integrally connected. The lugs 18, 19 are integrally connected with the engagement member 7. The lugs 16, 18 are facing the container opening. They can form gripping tabs. For this purpose, the lug 18 can be extended even more. The lugs 17, 19 are facing the interior of the container and form attachment lugs.

In the embodiments shown in the Figures, the projections 14, 15 have a hook-shaped design. They are tapered, the side faces being flat or slightly rounded and the tips being rounded. The spacing between the ends of the projections 14, 15 facing each other is larger than the width of the web 20 adjoining the engagement element 8, but smaller than the width of the tip 9 of the engagement element 8. Thereby, it is ensured that the tip 9 of the engagement element 8 can easily slide into the groove 5 and then is reliably retained there. Approximately in its middle, the web 20 has a thickened portion 21 on both sides, by means of which the relatively long web 20 is additionally stabilized. At its end facing away from the tip 9, the web 20 has an expansion 22 towards the lugs 18, 19. In the vicinity of the expansion 22, the lugs 18, 19 have a thickened portion 23 facing the bag wall 6.

In the vicinity of their outer ends, the lugs 16 to 19 are welded to the bag walls 3, 6 at points 24. Furthermore, the lugs 18, 19 of the engagement member 7 have two posts 25, 26, which are spaced from the engagement element 8 and extend parallel to the engagement element 8 or to the web 20 thereof. The posts 25, 26 are slightly shorter than the engagement element 8. They have a substantially rectangular cross-section. The distance of the posts 25, 26 from the engagement element 8 is larger than the distance of the upper outer ends of the webs 11, 12 from the middle of the groove member 4. As can be taken from FIG. 2, this distance of the posts 25, 26 is about 30% to 70% larger than the distance of the upper outer ends of the webs 11, 12 from the middle of the groove member 4, preferably about 40% to 60% larger, more preferably 50% larger.

Figure 3:
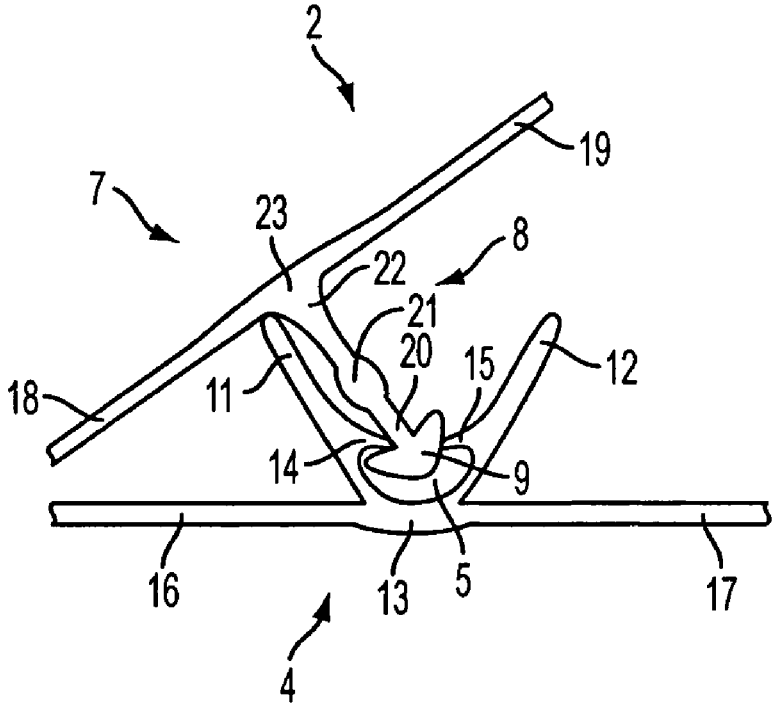
FIG. 3 shows a prior art press-on closure tape, likewise in a side view.

In the embodiment shown in FIG. 3, which substantially corresponds to an embodiment in accordance with EP 1 431 203 A1, it can occur that one of the two lugs of the engagement element 8 is pressed in with too much inclination, as shown in FIG. 3. This lug 18, which extends next to the engagement element 8, then first of all impinges on the tip of one of the funnel-shaped webs, namely of the funnel-shaped web 11, as is likewise shown in FIG. 3. In this position, the left part of the tip 9 of the engagement element 8 is interlocked with the projection 14 of the groove member 4. The other part of the tip 9 of the engagement element 8 is, however, not interlocked with the other projection 15 of the groove member 4. Since the lug 18 abuts against the tip of the web 11, the complete interlocking of the tip 9 with the groove 5 can only be effected by an extremely strong pressure, which is disadvantageous for the user.

This disadvantage is prevented or reduced by the inventive embodiment as shown in FIGS. 1 and 2. The supporting posts 25, 26, which are located to the left and to the right of and at a distance from the engagement element 8 at the two lugs 18, 19, effect that the engagement element 8 always impinges straight on the funnel formed by the webs 11, 12. The supporting posts 25, 26 prevent an inclined position of the lugs 18, 19 of the engagement element 8 by supporting the latter on both sides. In this way, an undisturbed sliding of the engagement element 8 into the groove member 4 as well as an undisturbed interlocking with the latter is ensured.

By means of the aspect in accordance with the present application, further advantages can be achieved: the supporting posts 25, 26 stabilize the entire engagement element 8 and the entire engagement member 7. By means of the supporting posts 25, 26, the total weight of the engagement member 7 substantially becomes just as large as that of the groove member 4, whereby extruding the press-on closure tape 2 is facilitated. When extruding the press-on closure tape 2 another advantage is obtained, as the funnel-shaped webs 11, 12 of the groove member 4 cannot be squeezed when closing the two halves of the tape (groove member 4 and engagement member 7) by means of the closing rollers. Another advantage finally is obtained when welding the press-on closure tape 2 into the film which forms the bag walls 3, 6. Since the lugs 16, 17 of the groove member just as the lugs 18, 19 of the engagement member 7 reliably lie horizontally, a safe impingement of the welding punches onto the lugs 16 to 19 at the welding points 24 is ensured.

The invention claimed is:

1. A press-on closure, comprising:

at least one groove member having a groove, which has funnel-shaped webs with inwardly pointing projections disposed along an intermediate region of the webs;

and at least one engagement member having an engagement element, whereon each side of the engagement element a supporting post is provided and wherein the supporting posts are about 2% to 20% shorter than the engagement element.

2. The press-on closure as claimed in claim 1 wherein the press-on closure is a press-on closure tape.

3. The press-on closure as claimed in claim 2, wherein the closure is made of plastics.

4. A reclosable bag or reclosable packaging, made of plastics, comprising the press-on closure tape as claimed in claim 2.

5. The reclosable bag or reclosable packaging as claimed in claim 4, wherein the reclosable bag or the reclosable packaging and the press-on closure are formed integrally.

6. The press-on closure as claimed in claim 1, wherein the supporting posts extend parallel to the engagement element.

7. The press-on closure as claimed in claim 1, wherein the supporting posts are slightly shorter than the engagement element.

8. The press-on closure as claimed in claim 1 wherein a distance from each of the supporting posts to the engagement element is about 30% to 70% larger than a distance from an upper outer end of each of the webs to the middle of the groove member.

9. A press-on closure, comprising:

at least one groove member having a groove, which has funnel-shaped webs with inwardly pointing projections disposed along an intermediate region of a projection of the funnel-shaped webs closer to a base of the webs than an upper outer end of the webs;

and at least one engagement member having an engagement element, wherein each side of the engagement element a supporting post is provided, said posts supporting both sides of the engagement element to facilitate engagement of the engagement element and the groove member in a non-inclined position;

wherein the supporting posts are about 2% to 20% shorter than the engagement element.

10. The press-on closure as claimed in claim 9 wherein a distance from each of the supporting posts to the engagement element is about 30% to 70% larger than a distance from the upper outer end of each of the webs to the middle of the groove member.

11. The press-on closure of claim 9 wherein the supporting posts are about 3% to 10% shorter than the engagement element.

12. The press-on closure of claim 9 wherein the supporting posts are about 5% to 6% shorter than the engagement element.

13. The press-on closure of claim 12 wherein an angle between the webs is about 60°.

14. The press-on closure of claim 12 wherein an angle between the webs lies in the range between 30° and 90°.

15. The press-on closure of claim 9, wherein the closure is made of plastics.

16. The press-on closure of claim 15, wherein the supporting posts extend substantially parallel to the engagement element.

17. The press-on closure as claimed in claim 16, wherein the supporting posts are slightly shorter than the engagement element.

18. A press-on closure, comprising:

at least one groove member including a funnel-shaped groove formed by a first web and a second web, wherein the first and second webs are joined at a lower end of the groove and are disposed further apart from each other at an upper end of the groove;

a first inward facing projection disposed along an intermediate surface of the first web facing the second web, wherein the intermediate surface is between the lower end and upper end of the groove;

a second inward facing projection disposed along an intermediate surface of the second web facing the first web, wherein the intermediate surface is between the lower end and upper end of the groove;

at least one engagement member having an engagement element, wherein each side of the engagement element a supporting post is provided, said posts supporting both sides of the engagement element to facilitate engagement of the engagement element and the groove member in a non-inclined position;

wherein the supporting posts are about 2% to 20% shorter than the engagement element and are each located at a distance from the engagement element that is about 30% to 70% larger than a distance from an outer surface of the upper end of each of the webs to the middle of the groove member.

19. The press-on closure as claimed in claim 18, wherein the first and second projections are closer to the lower end of the groove than the upper end.

* * * * *